US010905965B2

(12) United States Patent
Song

(10) Patent No.: US 10,905,965 B2
(45) Date of Patent: Feb. 2, 2021

(54) PAPER MODEL TOY

(71) Applicant: Myeungseok Song, Seoul (KR)

(72) Inventor: Myeungseok Song, Seoul (KR)

( * ) Notice: Subject to any disclaimer, the term of this patent is extended or adjusted under 35 U.S.C. 154(b) by 371 days.

(21) Appl. No.: 15/779,733

(22) PCT Filed: Nov. 23, 2016

(86) PCT No.: PCT/KR2016/013525
§ 371 (c)(1),
(2) Date: May 29, 2018

(87) PCT Pub. No.: WO2017/095064
PCT Pub. Date: Jun. 8, 2017

(65) Prior Publication Data

US 2020/0306656 A1 Oct. 1, 2020

(30) Foreign Application Priority Data

Dec. 2, 2015 (KR) ..... 10-2015-0170605

(51) Int. Cl.
*A63H 3/08* (2006.01)
*A63H 3/16* (2006.01)
*A63H 33/16* (2006.01)

(52) U.S. Cl.
CPC ..... *A63H 3/08* (2013.01); *A63H 3/16* (2013.01); *A63H 33/16* (2013.01)

(58) Field of Classification Search
CPC ... A63H 3/08; A63H 3/16; A63H 3/50; A63H 33/16
See application file for complete search history.

(56) References Cited

U.S. PATENT DOCUMENTS 998,243 A * 7/1911 Gibson ..... A63H 3/16 446/97
6,120,344 A * 9/2000 Brown ..... A63H 3/16 446/321

(Continued)

FOREIGN PATENT DOCUMENTS

KR 10-2001-0076128 A 8/2001
KR 20-0285506 Y1 8/2002

(Continued)

*Primary Examiner* — Eugene L Kim
*Assistant Examiner* — Alyssa M Hylinski
(74) *Attorney, Agent, or Firm* — KORUS Patent, LLC; Seong Il Jeong

(57) ABSTRACT

Disclosed herein is a paper model toy. The paper model toy includes: a head unit configured to form a polyhedral shape, and configured such that a hole is formed in the bottom surface thereof; the body unit including a head coupling portion configured to be inserted and coupled into the hole, and holes configured to receive arm units; the arm units each configured such that a coupling portion configured to be inserted and coupled into each of the holes is formed at an end thereof; a leg unit including a coupling portion configured to be coupled into the lower portion of the body unit and to be inserted and coupled into a cut line, and a reception space configured such that a support unit is inserted thereinto; and the support unit including a protrusion portion, and a support portion configured to support the protrusion portion.

11 Claims, 16 Drawing Sheets

(56) References Cited

U.S. PATENT DOCUMENTS

| | | | | |
|---|---|---|---|---|
| 7,277,045 | B2 * | 10/2007 | Budic | G01S 7/023 342/195 |
| 7,727,045 | B2 * | 6/2010 | Yasui | A63H 3/46 446/330 |
| 9,289,695 | B2 * | 3/2016 | Sadri | A63H 33/16 |
| 9,339,735 | B2 * | 5/2016 | Morris | A63H 33/16 |
| 2006/0135032 | A1 * | 6/2006 | Wijerama | G09B 11/10 446/108 |
| 2008/0289992 | A1 * | 11/2008 | Shepherd | A63H 33/16 206/575 |
| 2012/0309258 | A1 * | 12/2012 | Hawthorne | A63H 33/04 446/85 |
| 2013/0095723 | A1 * | 4/2013 | Sadri | B31D 5/04 446/101 |
| 2016/0129362 | A1 * | 5/2016 | Zebersky | A63H 33/16 446/488 |
| 2016/0339352 | A1 * | 11/2016 | Liu | A63H 33/06 |

FOREIGN PATENT DOCUMENTS

| | | | |
|---|---|---|---|
| KR | 10-2003-0084249 | A | 11/2003 |
| KR | 20-0387701 | Y1 | 6/2005 |
| KR | 10-0924226 | B1 | 11/2009 |
| KR | 10-2012-0067874 | A | 6/2012 |

* cited by examiner

PAPER MODEL TOY

TECHNICAL FIELD

The present invention relates to a paper model toy, and more specifically to a paper model toy which facilitates the assembly thereof, which enables individual components to be rotated, and which enables fastening or docking with a different paper model toy, thereby producing various effects.

BACKGROUND ART

Paper model toys are generally used to fabricate models, such as a human, an animal, a doll, a car, etc., in toy forms by means of paper.

Such paper model toys may be implemented in various shapes by means of paper and an adhesive. Conventional paper model toys generally form overall shapes by implementing specific shapes through the folding of paper and then coupling the specific shapes into each other by means of an adhesive, and thus individual components or joints cannot be rotated relative to each other.

Although some paper model toys are paper model toys fabricated using a fitting method in order to fabricate the toys without using an adhesive, paper model toys fabricated by fitting individual components or joints by means of a fitting method have a problem in that the individual components or joints cannot be rotated relative to each other.

Furthermore, there has not been yet developed a paper model toy which can form a set toy through coupling with a complete different paper model toy or which can produce a variety of characters through the coupling of a basic paper model toy with various ornaments or accessories.

PRIOR ART DOCUMENT

Patent Document (Patent document 1) Korean Utility Model Registration No. 20-0285506

DISCLOSURE

Technical Problem

The present invention has been conceived to overcome the above-described problems of the prior art, and an object of the present invention is to provide a paper model toy which facilitates the assembly thereof, which enables individual components to be rotated, and which enables fastening or coupling with a different paper model toy, thereby producing various effects.

Technical Solution

According to an exemplary embodiment of the present invention, there is provided a paper model toy, including: a head unit configured to form a polyhedral shape by means of previously formed fold lines and cut lines, and configured such that a hole into which a body unit is rotatably coupled is formed in the bottom surface thereof; the body unit including a head coupling portion configured to be inserted and coupled into the hole formed in the bottom surface of the head unit, and holes configured such that arm units are inserted and coupled thereinto; the arm units each configured such that a coupling portion configured to be inserted and coupled into each of the holes formed in the side surfaces of the body unit is formed at an end thereof; a leg unit including a coupling portion configured to be coupled into the lower portion of the body unit and to be inserted and coupled into a cut line formed on the side surface of the body unit, and a reception space configured such that a support unit is inserted thereinto; and the support unit including a protrusion portion configured to be inserted and coupled into the reception space formed in the lower portion of the leg unit, and a support portion configured to support the protrusion portion.

The head unit may include: a head portion formed in a polyhedral shape; and a body reception hole formed in the bottom surface of the head portion and configured to provide a space into which the head coupling portion of the body unit is inserted.

The body reception hole may be formed in a circular shape so that the head portion coupled into the body unit is rotatable.

The head portion may include: a head front portion printed with the shape of the face of a character, and generally formed in a polyhedral plate shape or a polyhedral plate shape with rounded corners; a head back portion disposed opposite to the head front portion, and formed to have a size and a shape corresponding to those of the head front portion; and a head side portion configured to connect the head front portion and the head back portion to each other.

The body unit may include: a body portion formed in a cuboid shape with open top and bottom surfaces; head coupling portions formed to extend upward from an end of the upper opening of the body portion; and arm reception holes formed in the left and right surfaces of the body portion, respectively, and configured to provide spaces into which the coupling portions of the arm units are inserted and coupled.

The head coupling portions may be formed on the front and back portions of the body portion, respectively, and be located opposite to each other, and side lines of the head coupling portions may be formed to protrude in curved shapes.

Each of the arm units may include: an arm base portion formed long in a bar shape with one open side; and arm coupling portions formed at the ends of the arm base portion, respectively, formed on one and remaining sides of the arm base portion in sideways "U" shapes, and disposed opposite to each other.

The leg unit may include: a leg portion coupled to the lower portion of the body unit, generally formed in a cuboid shape with open top and bottom surfaces, and configured such that a coupling portion configured to be inserted and coupled into the cut line formed in the side surface of the body unit is formed on the top thereof; and a support unit reception hole formed to have an open bottom surface in order to receive the support unit.

The support unit may include: a first support portion including a first support plate generally formed in a circular shape, and a reception hole formed at the center of the first support plate; and a second support portion including a second support plate generally formed in a circular shape, and a leg coupling protrusion portion formed to extend and protrude from the second support plate and configured to be inserted and coupled into the support unit reception hole.

The paper model toy may further include a coupling unit configured to enable coupling with a different paper model toy; and the coupling unit may include: a leg reception portion generally formed in a rectangular cuboid shape with an open top and bottom, and formed to have a size and a shape corresponding to those of the reception space into which the support unit is inserted; a coupling protrusion portion formed to protrude and extend from one side of the bottom of the leg reception portion, and configured to be inserted and coupled into the reception space of a different paper model toy; and a support portion formed to protrude and extend from the remaining side of the leg reception portion, and configured to function to support a coupled paper model toy to be coupled.

The paper model toy may further include a mask base formed to have a size and a shape corresponding to those of the head portion of the head unit, and a mask coupling protrusion formed to protrude from one side of the mask base and configured to be inserted and coupled into a mask coupling hole formed on one side of the head portion.

Advantageous Effects

According to the present invention, assembly is facilitated, individual components can be rotated, and fastening or coupling with a different paper model toy are enabled, thereby producing various effects.

MODE FOR INVENTION

Preferred embodiments of the present invention will be described in detail below with reference to the accompanying drawings.

Figure 1:
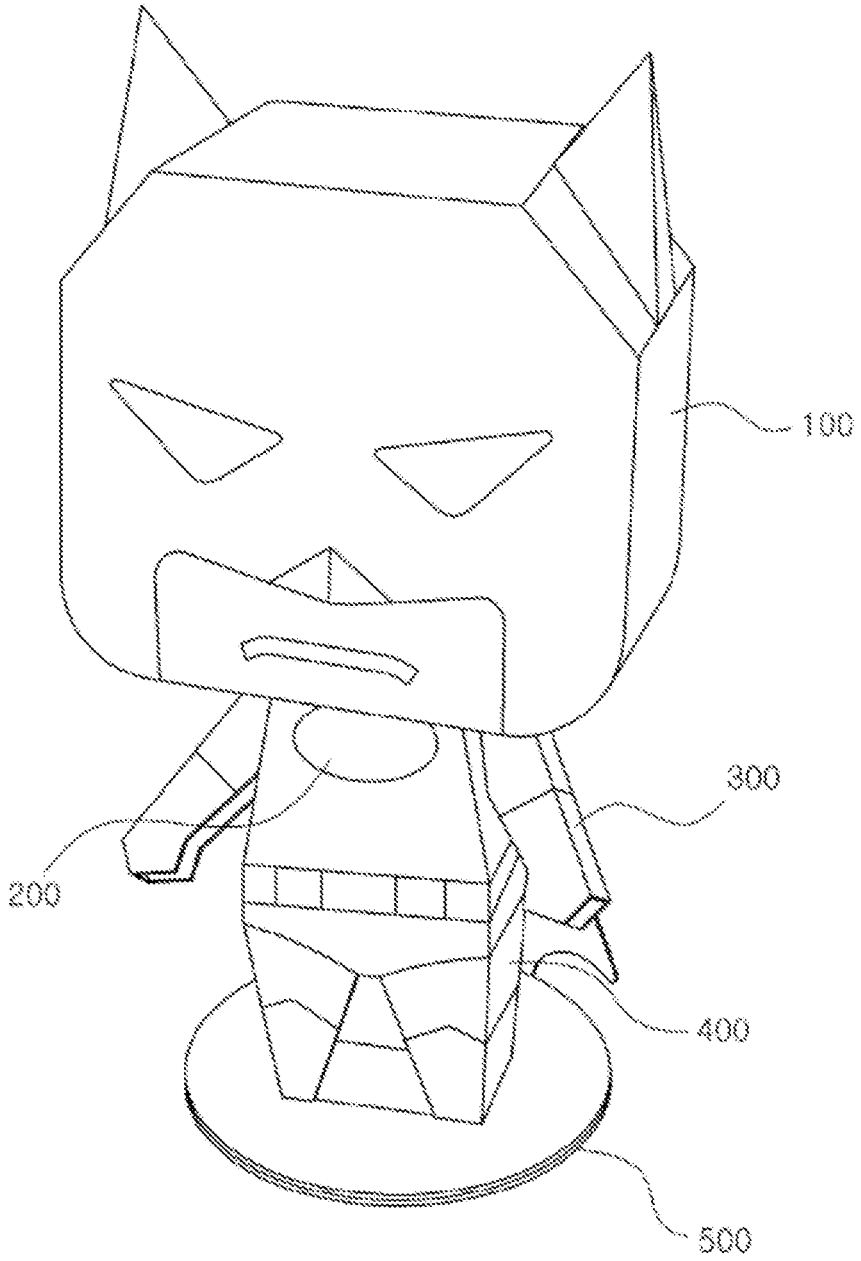
FIG. 1 is a schematic perspective view of a paper model toy according to an embodiment of the present invention.
Figure 2:
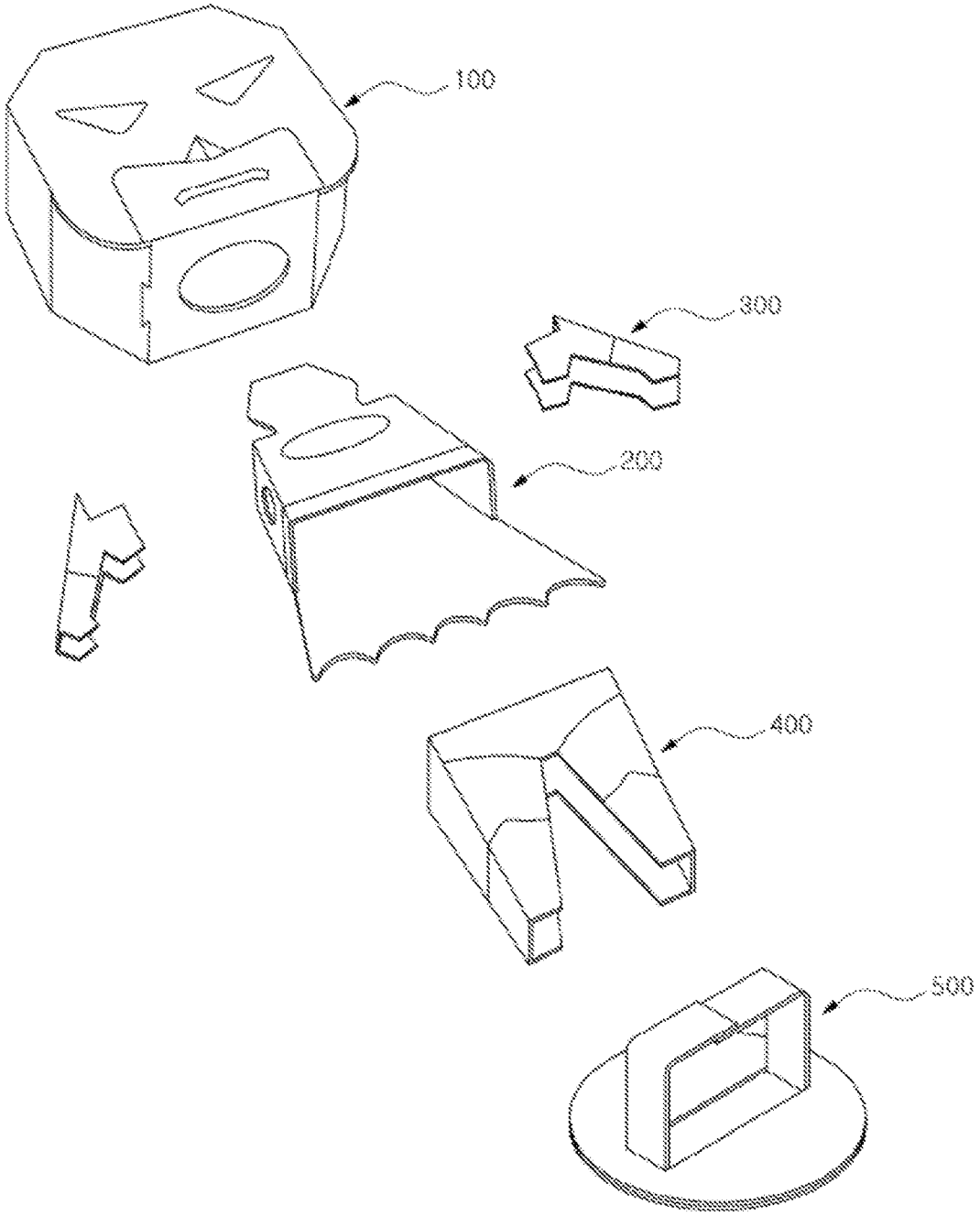
FIG. 2 is an exploded perspective view of the paper model toy according to the embodiment of the present invention.
Figure 3:
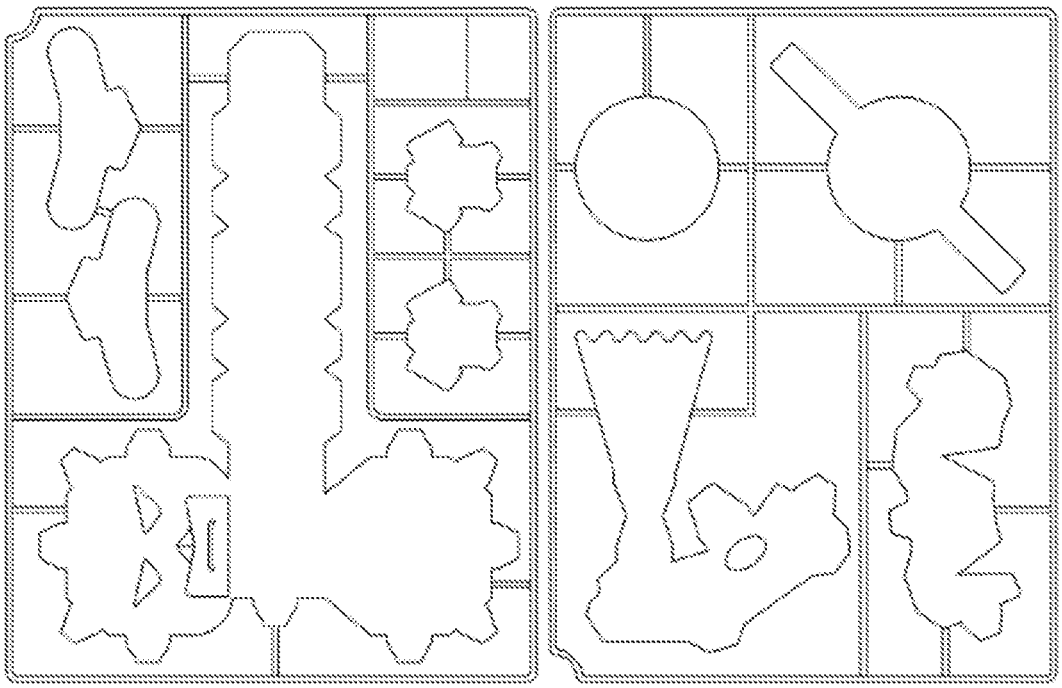
FIG. 3 is an overall plan view of the paper model toy according to the embodiment of the present invention.

FIG. 1 is a schematic perspective view of a paper model toy according to an embodiment of the present invention, FIG. 2 is an exploded perspective view of the paper model toy according to the embodiment of the present invention, and FIG. 3 is an overall plan view of the paper model toy according to the embodiment of the present invention.

Referring to FIGS. 1 to 3, the paper model toy according to the present embodiment includes a head unit 100, a body unit 200, arm units 300, a leg unit 400, and a support unit 500. The material of the paper model toy according to the present invention may be paper, paper to which a coating film has been applied, a foldable plastic plate, or the like. In the case of the present embodiment, a description will be given using paper as an example.

The head unit 100 is generally formed in a rectangular cuboid or polyhedral shape. A hole through which the body unit 200 is rotatably coupled is formed in the bottom surface of the head unit 100. The head unit 100 is folded along previously formed fold lines to thus form a rectangular cuboid or polyhedral shape, and is assembled using coupling protrusions and cut lines formed at locations corresponding to the coupling protrusions.

The body unit 200 is generally formed in a cuboid shape with open top and bottom surfaces. A head coupling portion configured to be inserted and fastened into the hole formed in the bottom surface of the head unit 100 is formed on the top of the body unit 200. A protrusion configured to be coupled with the leg unit 400 is formed to protrude from the bottom of the body unit 200. A cut line into which the coupling portion of the leg unit is inserted and coupled is formed in the lower end portion of the protrusion. Furthermore, holes into which the respective arm units 300 are inserted and coupled are formed in side surfaces of the body unit 200.

The body unit 200 is also folded along previously formed fold lines to thus form a cuboid shape with open top and bottom surfaces, and is assembled using the coupling protrusion and cut lines formed at locations corresponding to the coupling protrusions.

The arm units 300 are each configured be formed long in a bar shape with an open one side. Coupling portions configured to be inserted and coupled into the holes formed in the side surfaces of the body unit 200 are formed at the ends of the arm units 300. The arm units are each formed along previously formed fold lines to thus form a shape.

The leg unit 400 is coupled to the lower portion of the body unit 200, and generally forms a cuboid shape with open top and bottom surfaces. A coupling portion configured to be inserted and coupled into the cut line formed in the side surfaces of the body unit is formed on the upper portion of the leg unit 400. A reception space configured to receive the support unit 500 is formed in the lower portion of the leg unit 400.

The support unit 500 includes a protrusion portion configured to be inserted and coupled into the reception space formed in the lower portion of the leg unit 400 and a support portion configured to support the protrusion portion. The support portion of the support unit 500 is formed in a circular shape. The protrusion portion is formed to extend and protrude upward from the support portion.

Figure 4A:
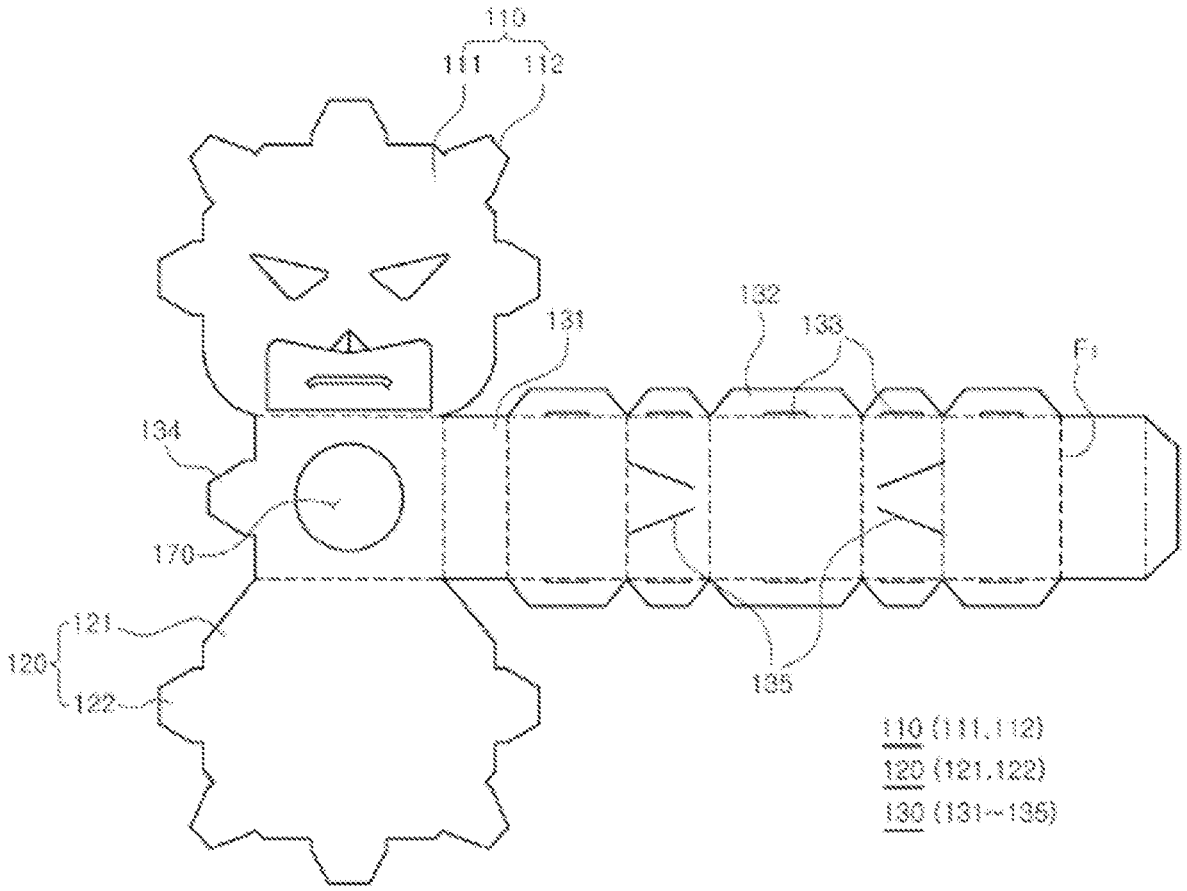
FIG. 4*a* is a development view of the head unit of the paper model toy.
Figure 4B:
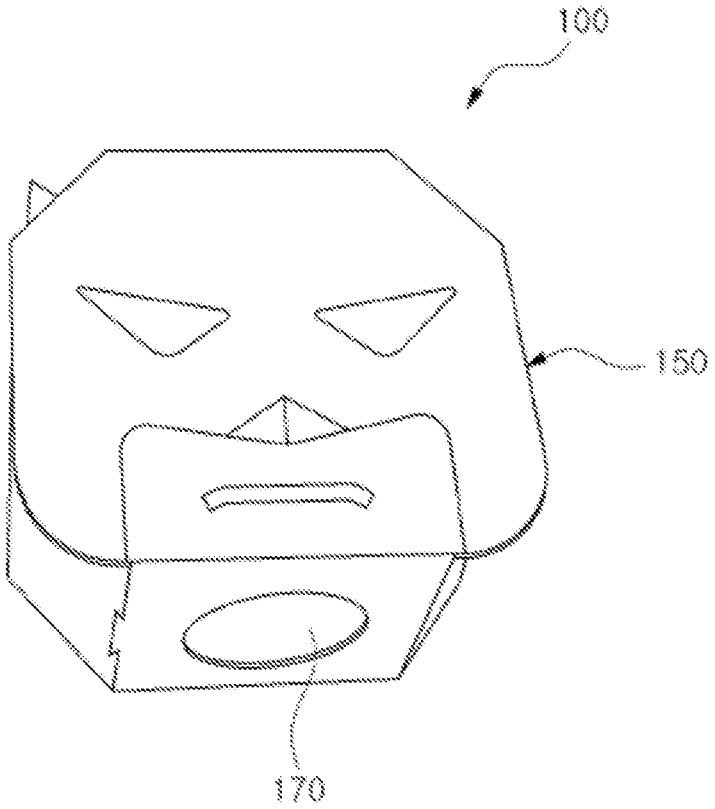
FIG. 4*b* is an assembled view of the head unit.

FIG. 4*a* is a development view of the head unit of the paper model toy, and FIG. 4*b* is an assembled view of the head unit.

Referring to FIGS. 4*a* and 4*b*, in the case of the present embodiment, the head unit 100 includes: a head portion 150 formed in a polyhedral shape; and a body reception hole 170 formed in the bottom surface of the head portion 150 and configured to provide a space into which the head coupling portion of the body unit is inserted. The body reception hole 170 is formed in a circular shape, and enables the head portion 150 coupled to the body unit to be desirably rotated.

The head portion 150 includes a head front portion 110, a head back portion 120, and a head side portion 130.

The head front portion 110 is printed with the shape of the face of a character, and is formed in a polyhedral shape or polyhedral plate shape with rounded corners. The head back portion 120 is disposed opposite to the head front portion 110, and has a size and a shape corresponding to those of the head front portion 110. The head side portion 130 is formed to connect the head front portion 110 and the head back portion 120 to each other.

The head front portion 110 includes a head front base 111, and head front coupling protrusions 112 formed to extend and protrude from the head front base 111. The head back portion 120 also includes a head back base 121, and head back coupling protrusions 122 formed to extend and protrude from the head back base 121.

The head side portion 130 includes a head side base 131, head side flaps 132 formed to extend from the head side base 131, side coupling cut lines 133 formed in the inside regions of the head side flaps 132 and configured to receive the head front coupling protrusions 112 and the head back coupling protrusions 122, a head side coupling protrusion 134 formed to protrude in order to form the shape of the head side portion, and decoration coupling cut lines 135 cut to insert and fasten a decoration into the head portion.

Figure 5A:
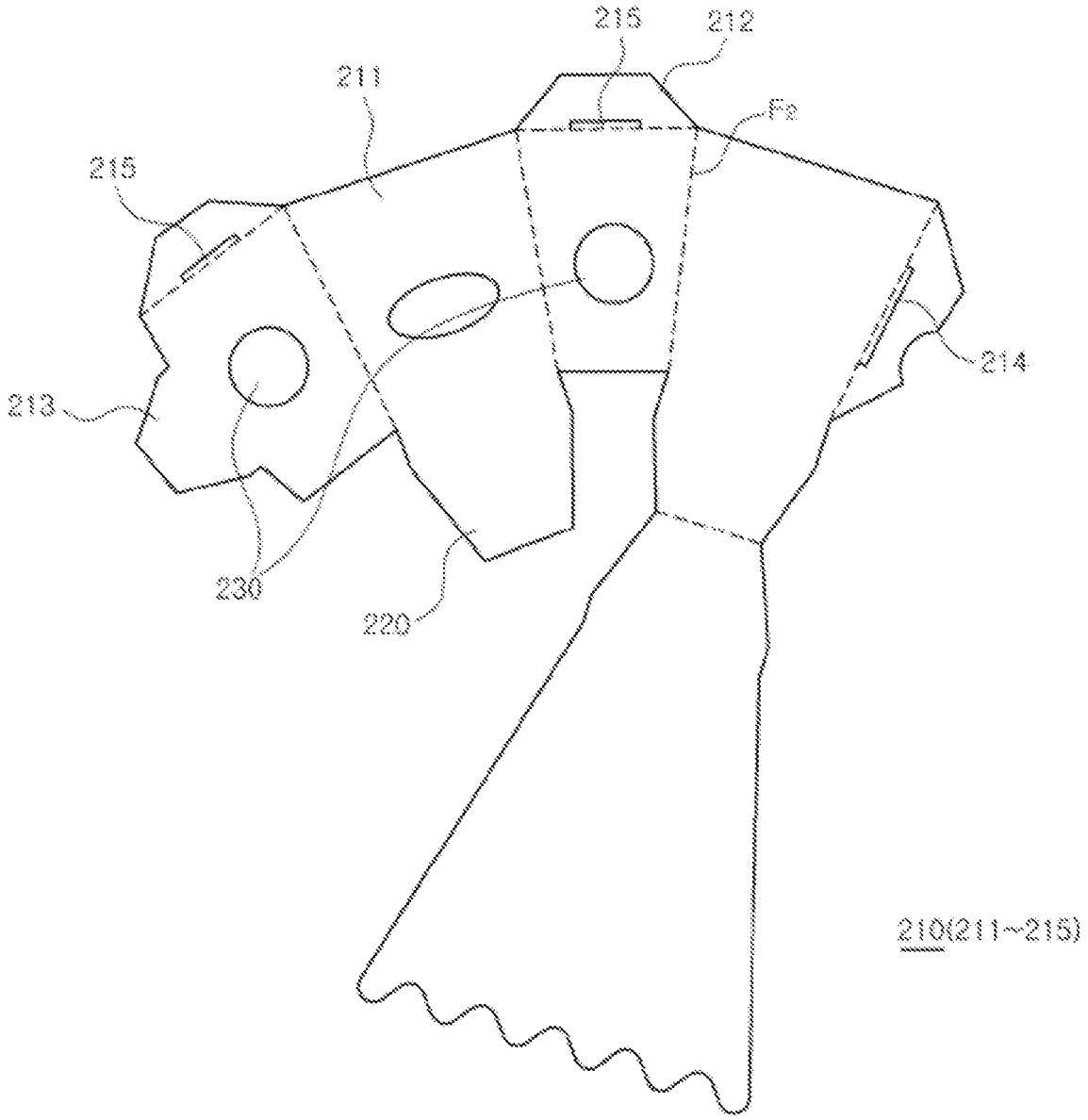
FIG. 5*a* is a development view of the body unit of the paper model toy.
Figure 5B:
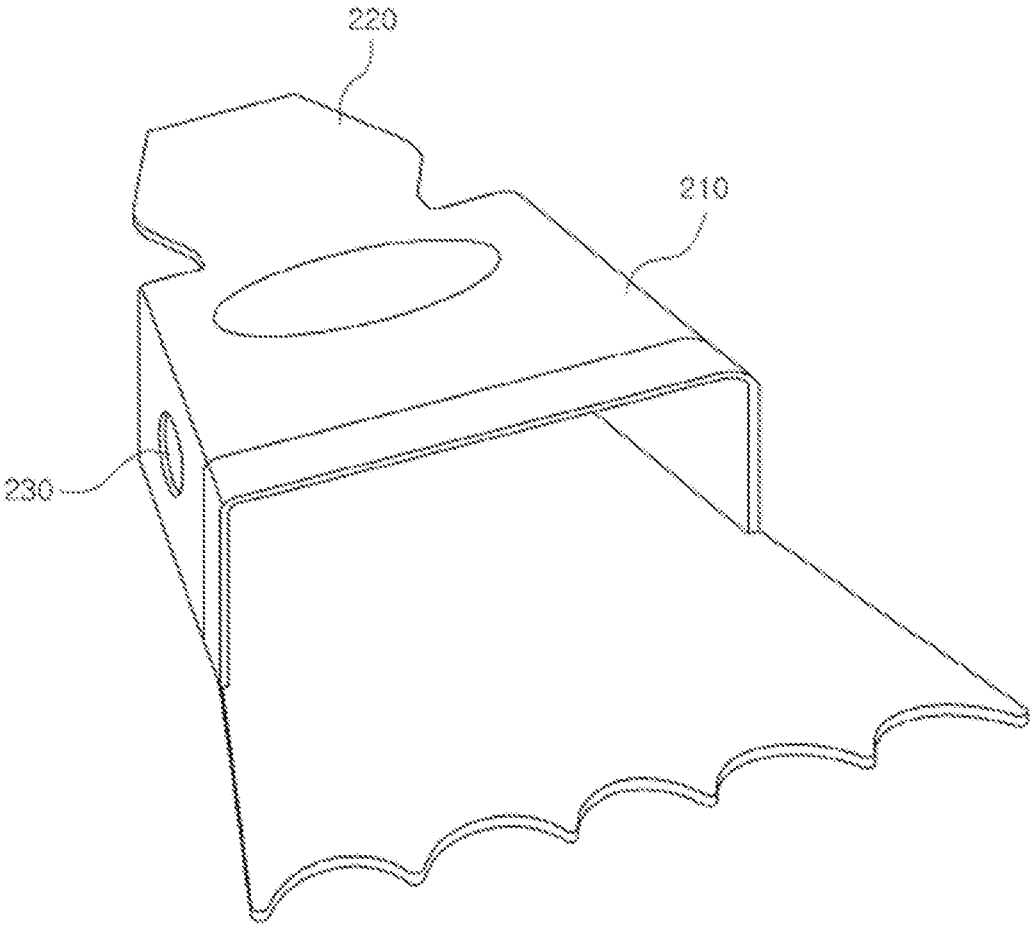
FIG. 5*b* is an assembled view of the body unit.

FIG. 5*a* is a development view of the body unit of the paper model toy, and FIG. 5*b* is an assembled view of the body unit.

Referring to FIGS. 5*a* and 5*b*, the body unit 200 includes a body portion 210, a head coupling portion 220, and arm reception holes 230.

The body portion 210 is generally formed in a cuboid shape with open top and bottom surfaces. In the case of the present embodiment, the body portion 210 is generally formed in a rectangular cuboid shape in which the size of a lower opening is formed to be larger than that of an upper opening.

The head coupling portions 220 are formed to extend upward from the end of the upper opening of the body portion 210. The head coupling portions 220 are formed on the front and back portions of the body portion 210, respectively, and are located opposite to each other. The side lines of the head coupling portions 220 are formed to protrude in curved shapes. The diameter of the body reception hole 170 of the head unit 100 is formed to have a size corresponding to that of the widest portions of the head coupling portions 220. When the head coupling portions 220 are inserted and coupled into the body reception hole 170, the head portion is not easily removed due to the protrusions of the head coupling portions 220, is separated only when the head portion is pulled with predetermined force, and is easily rotated.

The arm reception holes 230 are formed in the left and right surfaces of the body portion 210, and provide spaces into which the coupling portions of the arm units 300 are inserted and coupled. The arm reception holes 230 are formed in circular shapes, and enable the arm units to be freely rotated.

The configuration of the body portion 210 is described in greater detail. The body portion 210 includes a body base 211, body flaps 212, a body coupling protrusion 213, a body coupling cut line 214, and leg coupling cut lines 215. The body base 211 is generally formed in a shape in which trapezoidal plates are connected to each other. The body flaps 212 are formed to protrude from the bottom and one side of the body base 211. The body coupling protrusion 213 is formed to protrude from the other side of the body base 211, and is inserted and coupled into the body coupling cut line 214 formed in the body flap 212. The leg coupling cut lines 215 are formed by cutting parts of the body flaps 212 formed to protrude from the bottom of the body base 211.

Figure 6A:
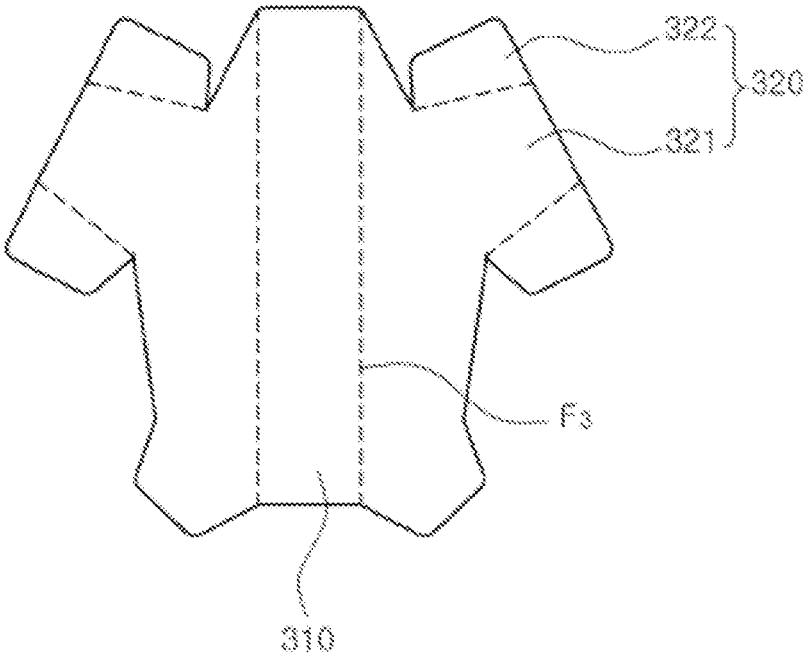
FIG. 6*a* is a development view of the arm unit of the paper model toy.
Figure 6B:
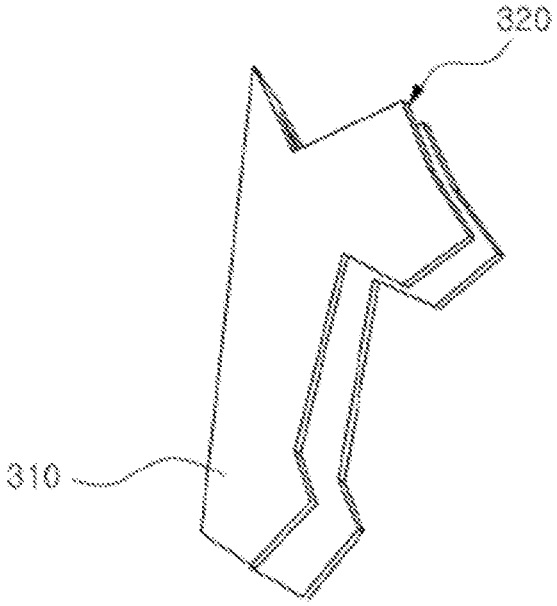
FIG. 6*b* is an assembled view of the arm unit.

FIG. 6*a* is a development view of the arm unit of the paper model toy, and FIG. 6*b* is an assembled view of the arm unit.

Referring to FIGS. 6*a* and 6*b*, the arm unit 300 includes an arm base portion 310, and arm coupling portions 320.

The arm base portion 310 is formed long in a bar shape with one open side, and has a sideways "U"-shaped section.

The arm coupling portions 320 are formed at ends of the arm base portion 310, are formed on the sides of the arm base portion 310 in sideways "U" shapes, and are disposed opposite to each other. Each of the arm coupling portions 320 includes an arm coupling protrusion 321, and arm flaps 322 formed on both sides of the arm coupling protrusion 321. The arm flaps 322 are formed to be folded along fold lines. These arm coupling portions 320 are inserted and coupled into the arm reception holes 230 formed in the body portion 210. The arm unit is prevented from being easily removed due to the arm flaps 322.

An accessory, e.g., a gun, a knife, or the like, may be inserted into an end of the arm unit 300, i.e., a side opposite to the side of the arm unit 300 on which the arm coupling portion 320 is formed. Protrusions having a size corresponding to that of the reception spaces of the arm units are formed at the ends of the accessory, and the protrusions are inserted and coupled into the spaces at the ends of the arm units.

Figure 7A:
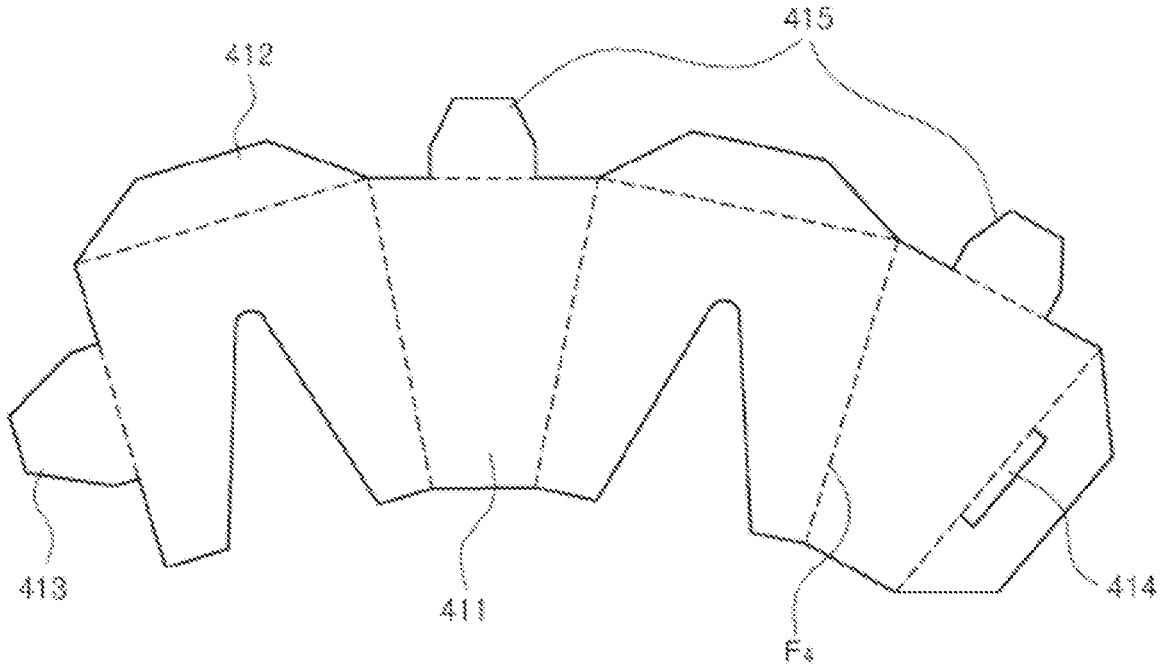
FIG. 7*a* is a development view of the leg unit of the paper model toy.
Figure 7B:
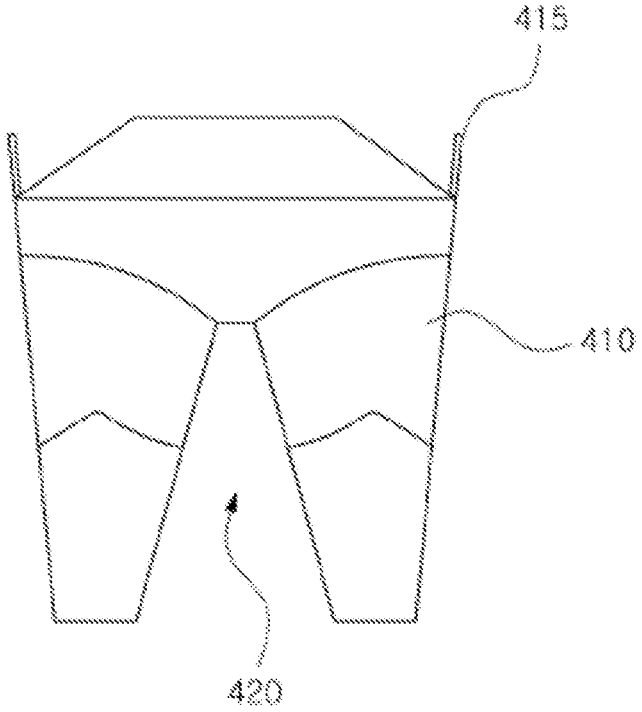
FIG. 7*b* is an assembled view of the leg unit.

FIG. 7*a* is a development view of the leg unit of the paper model toy, and FIG. 7*b* is an assembled view of the leg unit.

Referring to FIGS. 7*a* and 7*b*, the leg unit 400 includes a leg portion 410 and a support unit reception hole 420.

The leg portion 410 is coupled to the lower portion of the body unit 200, and is generally formed in a cuboid shape with open top and bottom surfaces. A coupling portion configured to be inserted and coupled into the cut line formed in the side surface of the body unit is formed on the top of the leg portion 410.

The bottom surface of the leg portion 410 is formed to be open. The support unit reception hole 420 through which the support unit 500 is inserted is formed in the leg portion 410.

The configuration of the leg portion 410 will be described in detail. The leg portion 410 includes a leg base 411, leg flaps 412, a leg coupling protrusion 413, a leg coupling cut line 414, and body coupling protrusions 415.

The leg base 411 is generally formed in a shape in which trapezoidal plates are connected to each other. A "V"-shaped cutout is formed in each of some of the plates.

The leg flaps 412 are formed to protrude from the top and one side of the leg base 411. The leg coupling protrusion 413 is formed to protrude from the other side of the leg base 411, and is inserted and coupled into the leg coupling cut line 414 formed in the leg flap 412. The leg coupling cut line 414 is formed by cutting part of the leg flap 412 formed to protrude from one side of the leg base 411. The body coupling protrusions 415 are formed to protrude from the top of the leg base 411, are inserted and coupled to the leg coupling cut lines 215 of the body unit, and couple the leg unit and the body unit to each other.

Figure 8A:
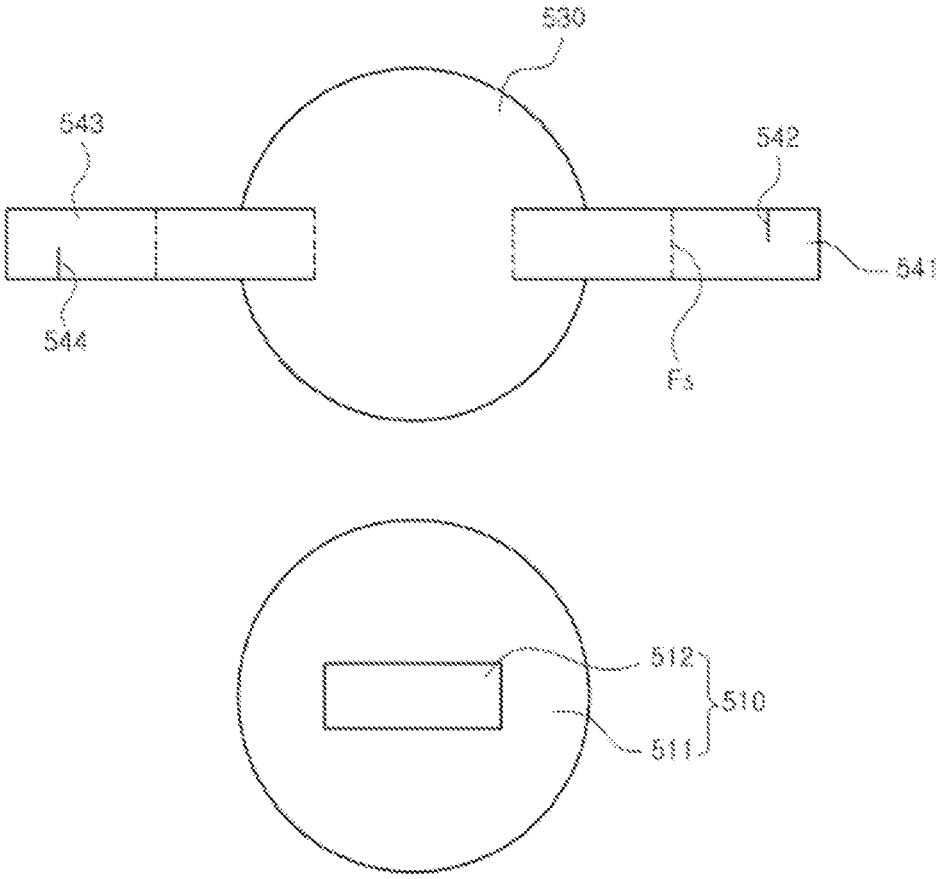
FIG. 8*a* is a development view of the support unit of the paper model toy.
Figure 8B:
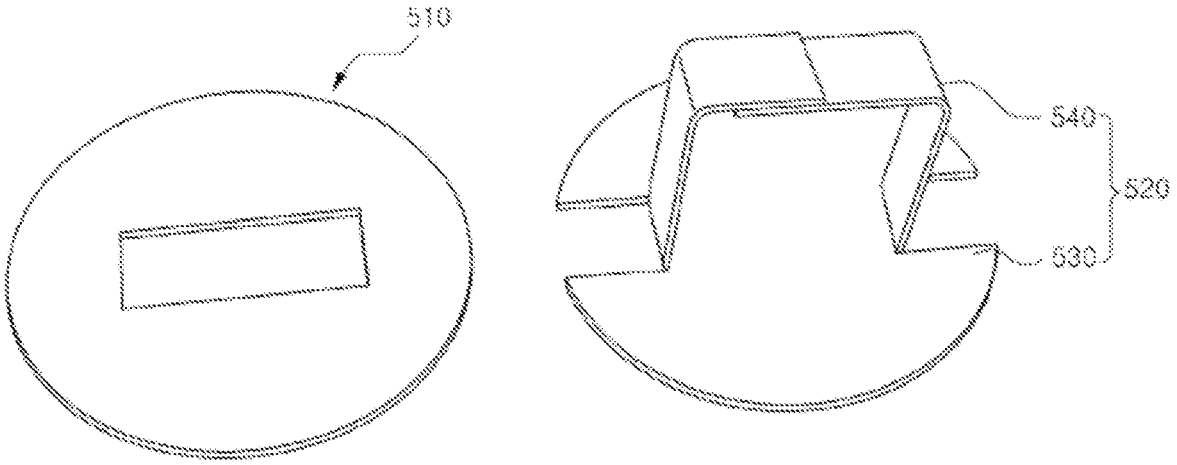
FIG. 8*b* is an assembled view of the support unit.

FIG. 8*a* is a development view of the support unit of the paper model toy, and FIG. 8*b* is an assembled view of the support unit.

Referring to FIGS. 8*a* and 8*b*, the support unit 500 includes a first support portion 510, and a second support portion 520.

The first support portion 510 includes a first support plate 511, and a reception hole 512. The first support plate 511 is generally formed in a circular shape, and the reception hole 512 is formed in a rectangular shape at the center of the first support plate 511. The size of the reception hole 512 is formed to correspond to that of a leg coupling protrusion portion to be described below.

The second support portion 520 includes a second support plate 530, and the leg coupling protrusion portion 540. The second support plate 530 is generally formed in a circular shape, and the leg coupling protrusion portion 540 is formed to extend and protrude from the second support plate 530. The leg coupling protrusion portion is inserted and coupled into the support unit reception hole 420 of the leg unit 400.

The leg coupling protrusion portion 540 includes a first coupling protrusion 541, a first coupling protrusion cut line 542, a second coupling protrusion 543, and a second coupling protrusion cut line 544. The first coupling protrusion 541 is formed to protrude and extend from one side of the second support plate 530, and the second coupling protrusion 543 is formed to protrude and extend from the other side of the second support plate 530 (i.e., in a direction opposite to that of the first coupling protrusion). The first coupling protrusion cut line 542 is formed by cutting part of the top surface of the first coupling protrusion 541, and the second coupling protrusion cut line 544 is formed by cutting part of the bottom surface of the second coupling protrusion 543. The leg coupling protrusion portion 540 is formed by performing bending along bend lines F5 and fitting the first coupling protrusion cut line 542 and the second coupling protrusion cut line 544 into each other.

Figure 9A:
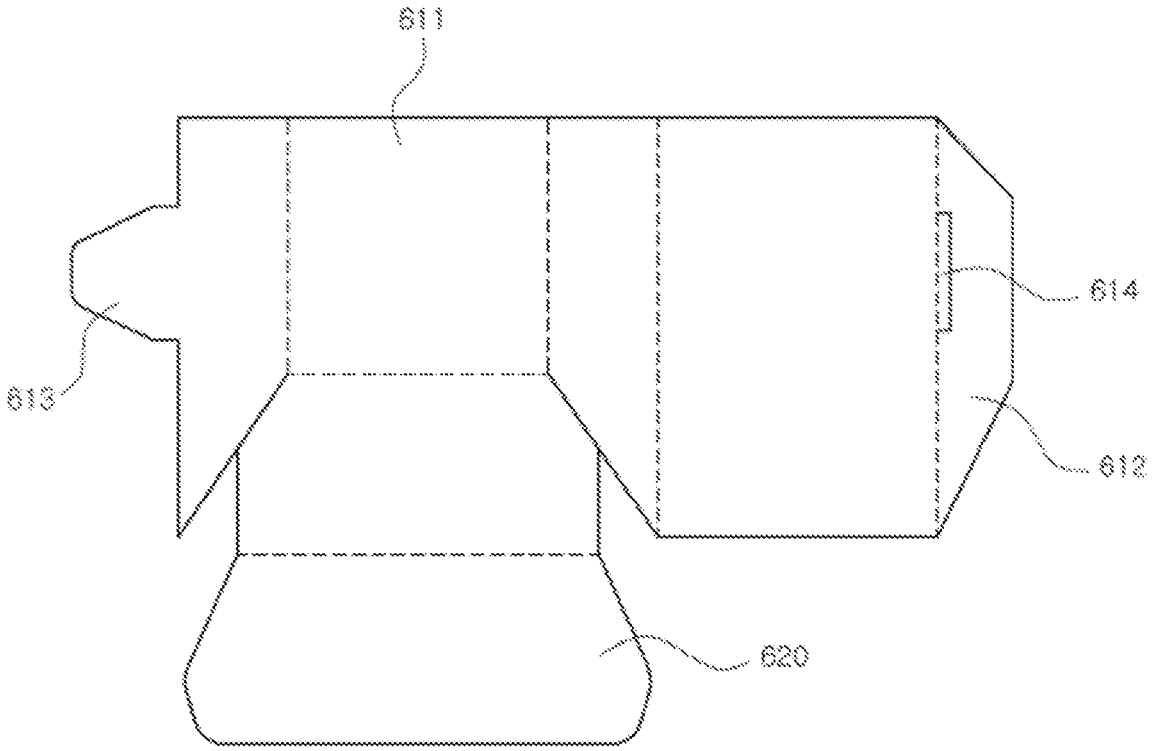
FIG. 9*a* is a development view of the coupling unit of the paper model toy.
Figure 9B:
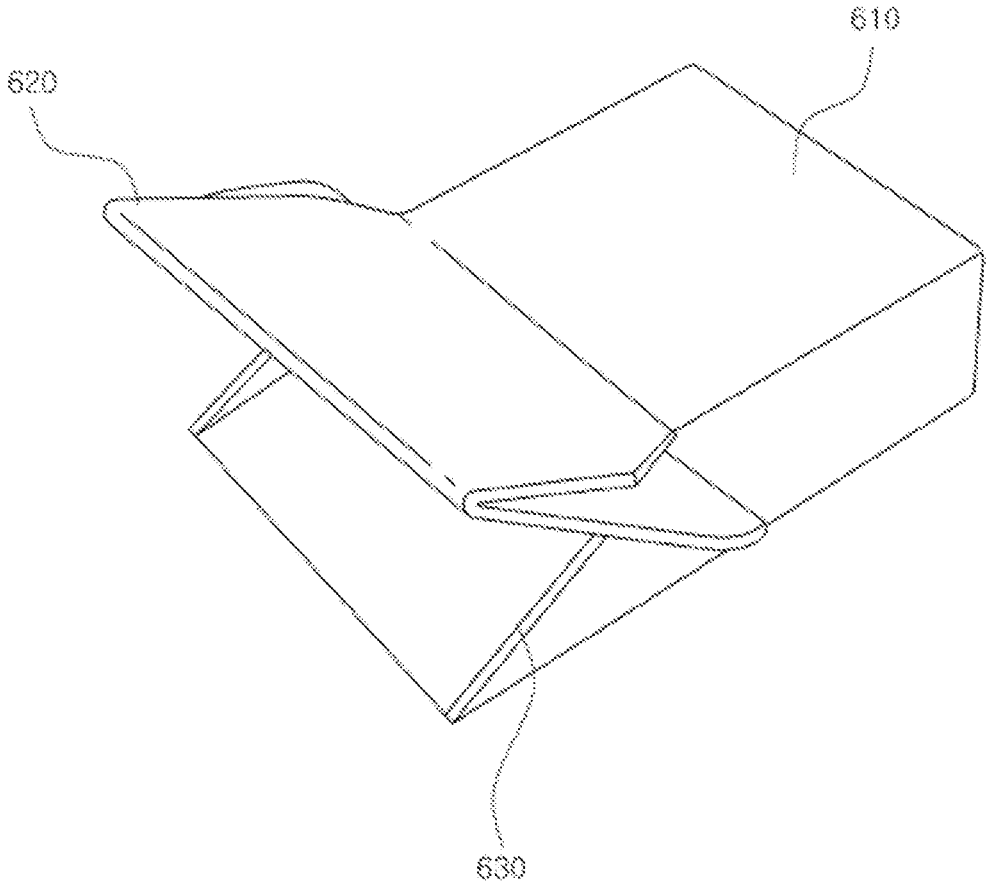
FIG. 9*b* is an assembled view of the coupling unit.
Figure 10:
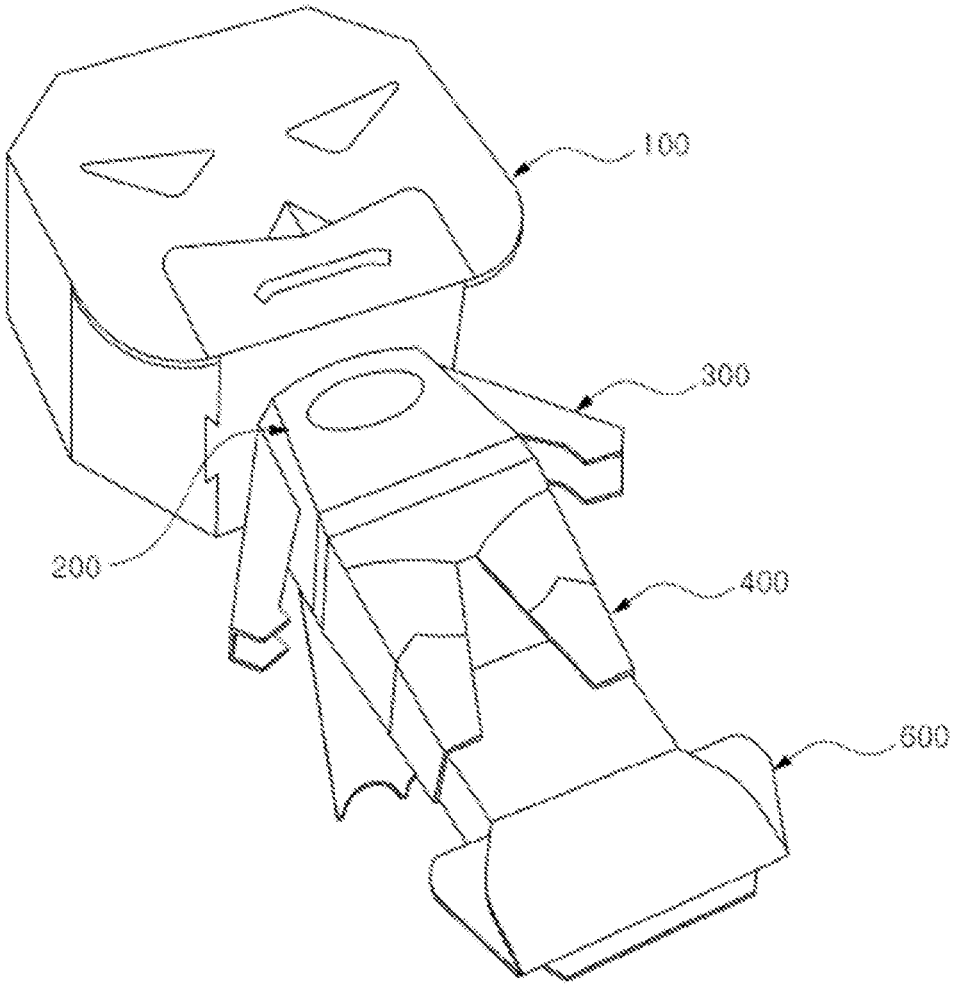
FIG. 10 is a view showing a state in which the coupling unit is coupled to the body unit of the paper model toy.
Figure 11:
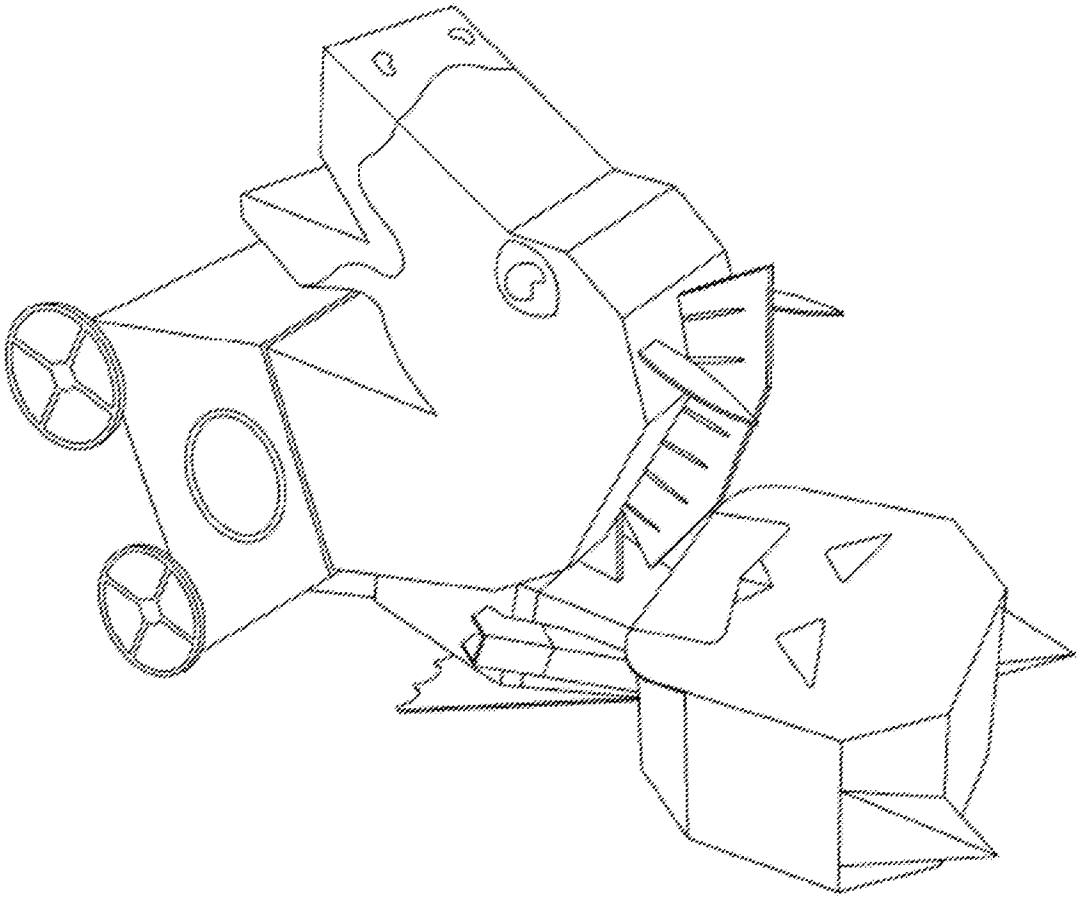
FIGS. 11 and 12 are views showing a state in which different paper model toys are coupled using the coupling unit.
Figure 12:
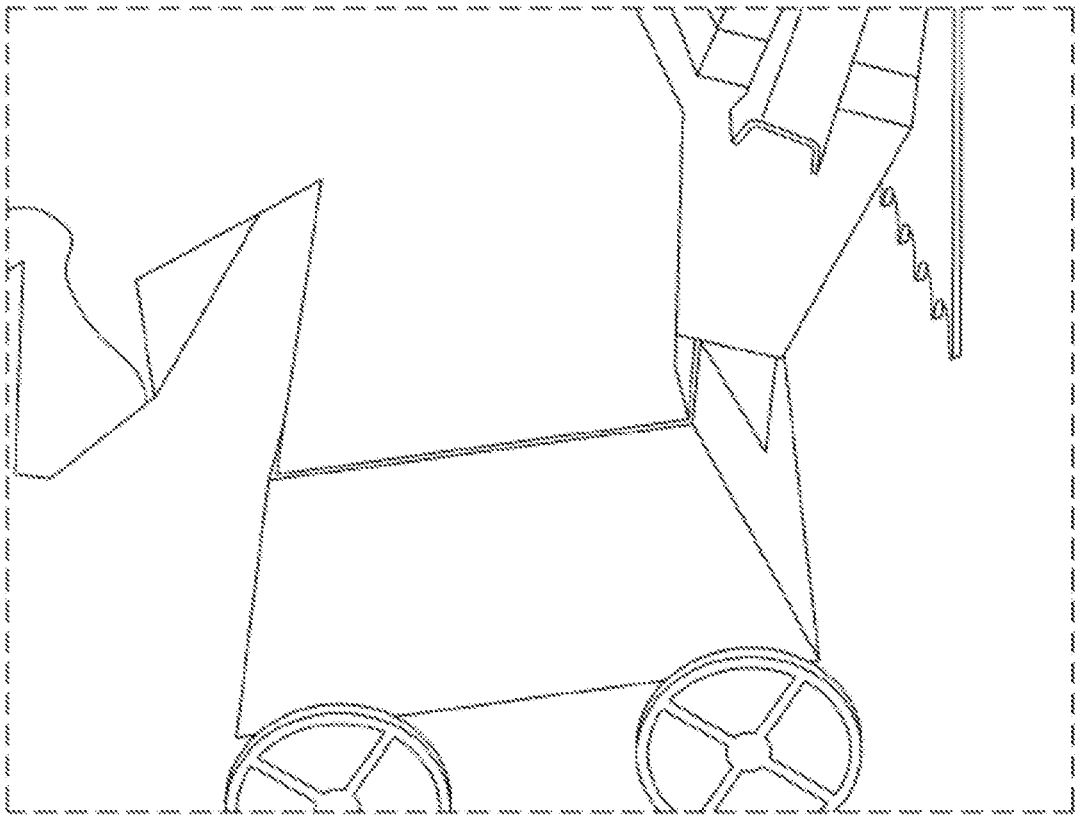

FIG. 9*a* is a development view of the coupling unit of the paper model toy, and FIG. 9*b* is an assembled view of the coupling unit; FIG. 10 is a view showing a state in which the coupling unit is coupled to the body unit of the paper model toy; and FIGS. 11 and 12 are views showing a state in which different paper model toys are coupled using the coupling unit.

Referring to FIGS. 9*a* and 9*b*, the coupling unit 600 includes a leg reception portion 610, a coupling protrusion portion 620, and a support portion 630.

The leg reception portion 610 is generally formed in a rectangular cuboid shape with an open top and bottom. The leg reception portion 610 is formed to have a size and a shape corresponding to those of the support unit reception hole 420 of the leg unit 400, and may be selectively inserted and coupled into and separated from the support unit reception hole 420.

The coupling protrusion portion 620 is formed to protrude and extend from one side of the bottom of the leg reception portion 610. The coupling protrusion portion 620 is inserted and coupled into the reception space of a different paper model toy, and enables coupling with the different paper model toy.

The support portion 630 is formed to protrude and extend from the other side of the leg reception portion, and functions to support a coupled paper model toy in order to prevent the coupled paper model toy from collapsing.

The configuration of the leg reception portion 610 is described in detail. The leg reception portion 610 includes a leg reception portion base 611, a leg reception portion flap 612, a leg reception portion coupling protrusion 613, and a leg reception portion coupling cut line 614.

The leg reception portion base 611 is generally formed in a rectangular shape. The leg reception portion flap 612 is formed to extend from one side of the leg reception portion base 611. The leg reception portion coupling cut line 614 is formed in the inside center region of the leg reception portion flap 612. The leg reception portion coupling protrusion 613 is formed to protrude from the other side of the leg reception portion base 611, and is inserted and coupled into the leg reception portion coupling cut line 614.

Referring to FIGS. 10 to 12, there is shown a state in which in order to couple different paper model toys to each other, the support unit 500 has been separated, the coupling unit 600 has been inserted and coupled in place of the support unit 500, and the coupling unit 600 has been inserted and coupled into the reception space of a different paper model toy.

Figure 13:
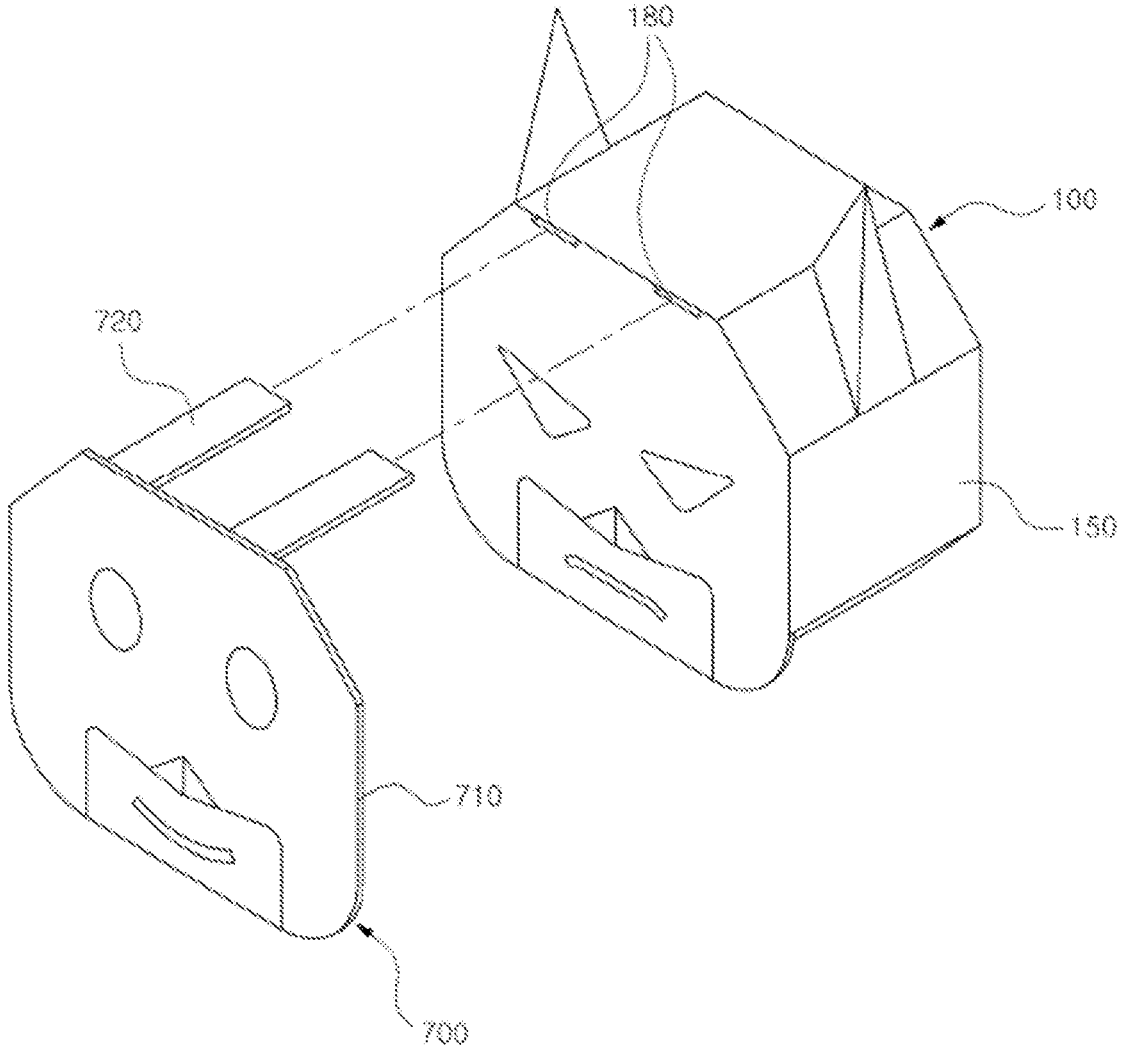
FIG. 13 is a view showing the mask unit of a paper model toy according to another embodiment of the present invention.

FIG. 13 is a view showing the mask unit of a paper model toy according to another embodiment of the present invention.

Referring to FIG. 13, the mask unit 700 may produce various effects through the production of various facial expressions of the paper model toy or the wearing of a mask by means of a method of being inserted and coupled into the head portion.

The mask unit 700 includes a mask base 710, and mask coupling protrusions 720. The mask base 710 is formed to have a size and a shape corresponding to those of the head portion 150 of the head unit. The mask coupling protrusion 720 is formed to protrude from one side of the mask base 710, and is inserted and coupled into a mask coupling hole 180 formed on one side of the head portion 150.

The above description concerns merely exemplary embodiments of the paper model toy according to the present invention. The present invention is not limited to the above embodiments. As claimed in the attached claims, the technical spirit of the present invention resides in a range within which those having ordinary knowledge in the art to which the present invention pertains can make and practice various alterations without departing from the gist of the present invention.

DESCRIPTION OF REFERENCE SYMBOLS

100: head unit
200: body unit
300: arm unit
400: leg unit
500: support unit
600: coupling unit
700: mask unit

The invention claimed is:

1. A paper model toy, comprising:

a head unit configured to form a polyhedral shape by means of previously formed fold lines and cut lines, and configured such that a body reception hole into which a body unit is rotatably coupled is formed in a bottom surface thereof;

the body unit comprising a head coupling portion configured to be inserted and coupled into the body reception hole formed in the bottom surface of the head unit, and arm reception holes formed in side surfaces thereof configured such that arm units are inserted and coupled thereinto;

the arm units each configured such that coupling portions configured to be inserted and coupled into each of the arm reception holes formed in the side surfaces of the body unit are formed at an end thereof;

a leg unit comprising a coupling portion configured to be coupled into a lower portion of the body unit and to be inserted and coupled into a cut line formed on a side surface of the body unit, and a support unit reception hole formed in a lower portion thereof configured such that a support unit is inserted thereinto; and the support unit comprising a leg coupling protrusion portion configured to be inserted and coupled into the support unit reception hole formed in the lower portion of the leg unit, and a support portion configured to support the protrusion portion.

2. The paper model toy of claim 1, wherein the head unit comprises:

a head portion formed in the polyhedral shape, wherein the body reception hole is formed in a bottom surface of the head portion.

3. The paper model toy of claim 2, wherein the body reception hole is formed in a circular shape so that the head portion coupled to the body unit is rotatable.

4. The paper model toy of claim 2, wherein the head portion comprises:

a head front portion printed with a shape of a face of a character, and generally formed in a polyhedral plate shape or a polyhedral plate shape with rounded corners;

a head back portion disposed opposite to the head front portion, and formed to have a size and a shape corresponding to those of the head front portion; and a head side portion configured to connect the head front portion and the head back portion to each other.

5. The paper model toy of claim 1, wherein the body unit comprises:

a body portion formed in a cuboid shape with open top and bottom surfaces, wherein the head coupling portion is formed to extend upward from an end of an upper opening of the body portion; and the arm reception holes are formed in left and right surfaces of the body portion, respectively, and configured to provide spaces into which the coupling portions of the arm units are inserted and coupled.

6. The paper model toy of claim 5, wherein the head coupling portions are formed on front and back portions of the body portion, respectively, and are located opposite to each other, and side lines of the head coupling portions are formed to protrude in curved shapes.

7. The paper model toy of claim 1, wherein each of the arm units comprises:

an arm base portion formed in an elongated bar shape with one open side, the arm base portion having a sideways "U" shaped section; and arm coupling portions formed on left and right sides of the arm base portion, respectively, and disposed opposite to each other.

8. The paper model toy of claim 1, wherein the leg unit comprises:

a leg portion coupled to a lower portion of the body unit, generally formed in a cuboid shape with open top and bottom surfaces, and configured such that the coupling portion configured to be inserted and coupled into the cut line formed in the side surface of the body unit is formed on a top thereof, wherein the support unit reception hole is formed to have an open bottom surface in order to receive the support unit.

9. The paper model toy of claim 1, wherein the support portion comprises:

a first support portion comprising a first support plate generally formed in a circular shape, and a reception hole formed at a center of the first support plate; and a second support portion comprising a second support plate generally formed in a circular shape, wherein the leg coupling protrusion portion is formed to extend and protrude from the second support plate and configured to be inserted through the reception hole formed at the center of the first support plate and then inserted and coupled into the support unit reception hole.

10. The paper model toy of claim 1, further comprising a coupling unit configured to enable coupling with a different paper model toy;

wherein the coupling unit comprises:

a leg reception portion generally formed in a rectangular cuboid shape with an open top and bottom, and formed to have a size and a shape corresponding to those of the support unit reception hole into which the support unit is inserted;

a coupling protrusion portion formed to protrude and extend from one side of a bottom of the leg reception portion, and configured to be inserted and coupled into a reception space of the different paper model toy; and a support portion formed to protrude and extend from a remaining side of the leg reception portion, and configured to function to support the paper model toy coupled to the different paper model toy.

11. The paper model toy of claim 2, further comprising a mask base formed to have a size and a shape corresponding to those of the head portion of the head unit, and a mask coupling protrusion formed to protrude from one side of the mask base and configured to be inserted and coupled into a mask coupling hole formed on one side of the head portion.

* * * * *